United States Patent [19]

Kigyos

[11] Patent Number: 4,998,779

[45] Date of Patent: Mar. 12, 1991

[54] APPARATUS AND METHODOLOGY FOR PRODUCING ROUNDED BRUSH TIPS

[75] Inventor: Frank M. Kigyos, Sugar Grove, Ill.

[73] Assignee: North American Philips Corporation, New York, N.Y.

[21] Appl. No.: 457,021

[22] Filed: Dec. 26, 1989

[51] Int. Cl.[5] ..... A46D 1/08

[52] U.S. Cl. ..... 300/10; 300/21; 432/124

[58] Field of Search ..... 300/21, 10, 9, 2; 264/243; 15/159 A; 432/124, 138, 139

[56] References Cited

U.S. PATENT DOCUMENTS

| | | | |
|---|---|---|---|
| 3,740,868 | 6/1973 | Moore et al. | 432/124 X |
| 3,843,316 | 10/1974 | Amberg et al. | 432/124 |
| 4,030,158 | 6/1977 | Blair et al. | 15/159 A |
| 4,606,723 | 8/1986 | Pasternicki | 432/124 |
| 4,619,012 | 10/1986 | Wachtel | 15/159 A X |
| 4,635,659 | 1/1987 | Spatz | 264/243 X |
| 4,762,373 | 8/1988 | Amos et al. | 300/21 |
| 4,927,281 | 5/1990 | Gueret | 15/159 A X |

*Primary Examiner*—Mark Rosenbaum
*Assistant Examiner*—Frances Chin
*Attorney, Agent, or Firm*—Oblon, Spivak, McClelland, Maier & Neustadt

[57] ABSTRACT

Apparatus and methodology for rounding the bristle tips of twisted wire brushes. Each twisted wire brush is mounted in a carrier by means of a spindle which permits the brush to be rotated along its longitudinal axis. The melting of the synthetic bristle tips takes place in a heated chamber which includes one or more heated cylindrical cavities which may extend over a portion or the whole of the length of each brush. When the carrier approaches the chamber, the chamber is lowered over the carrier so that each of the individual brushes is inserted into a heated cavity. When inserted in the cavity, the brush is rotated on the spindle while it is heated. The rotation and heating causes the individual bristle tips to melt into a rounded ball without adhering to each other. Thereafter, the heating chamber is raised, the carrier is indexed, and the process is repeated.

14 Claims, 2 Drawing Sheets

APPARATUS AND METHODOLOGY FOR PRODUCING ROUNDED BRUSH TIPS

BACKGROUND OF THE INVENTION

This invention is directed to apparatus and methodology for rounding the bristle tips of twisted wire brushes.

Twisted wire brushes are used in a variety of applications, particularly in personal care products. These brushes consist of a multiplicity of fine synthetic bristles held and secured by a pair of twisted metal wires which form the core of the brush. The bristles extend in various directions from the twisted wires and the overall brush has a cylindrical or a tapered cylindrical outer surface. The bristles are generally formed by thin nylon or plastic filaments. Because the bristle tips are cut, the ends of the bristles are quite sharp and can cause injury if inserted in the eye. This is a particular problem when the twisted wire brush is used as a mascara brush, which is a common application. Hollow bristle filaments have recently come into use since they are quite flexible and provide a uniform cylindrical appearance to the brush. However, the tips of these filaments are even sharper than solid filament bristles with a consequent increased possibility of injury.

A variety of processes have been proposed for rounding the bristle tips of various types of brushes. Such processes have included bringing the bristle tips into contact with a heated surface. Non-contact processes have included the use of heat lamps or laser beams acting on the bristle tips to melt same. However, these processes have generally been applicable only to brushes in which all of the bristles are oriented in the same direction, such as hair brushes. Such processes are unsatisfactory for use with brushes having a cylindrical outer surface such as twisted wire brushes.

SUMMARY OF THE INVENTION

The present invention is directed to apparatus and methodology for rounding or balling the ends of the synthetic bristles of twisted wire brush. The invention operates without contact with the bristles and in a manner suitable for high speed manufacturing on an assembly line basis.

The invention operates on the twisted wire brushes after the twisting process. Each twisted wire brush is mounted in a moveable carrier by means of a spindle which permits the brush to be rotated along its longitudinal axis. The melting of the bristle tips takes place in a heated chamber which includes one or more heated cylindrical cavities. When the carrier approaches the chamber, the chamber is lowered over the carrier so that each of the individual brushes is inserted into a heated cavity. When inserted in the cavity, the brush spindle is rotated by an external drive motor so that the brush is rotated while it is heated. The rotation and heating causes the individual bristle tips to melt into a rounded ball without adhering to each other. After a predetermined period of time, the heating chamber is raised and the now finished brushes displaced by the carrier. The process is thereafter repeated on the next set of brushes. Different configuration heating chambers may be used to process the brush tips along the entire length of the brush or along only a preselected portion.

The improved apparatus and methodology set forth herein provides an efficient and relatively inexpensive processing for the rounding of the synthetic filament bristle tips of twisted wire brushes suitable for use in cosmetic application. The tiny spheres forming the tips of the processed bristles reduce the chance of injury and aid in the retention of the liquid to be applied by the brush.

BRIEF DESCRIPTION OF THE DRAWINGS

For a better understanding of the invention, reference is made to the following drawings in which.

DETAILED DESCRIPTION OF THE PREFERRED EMBODIMENTS

Figure 1:
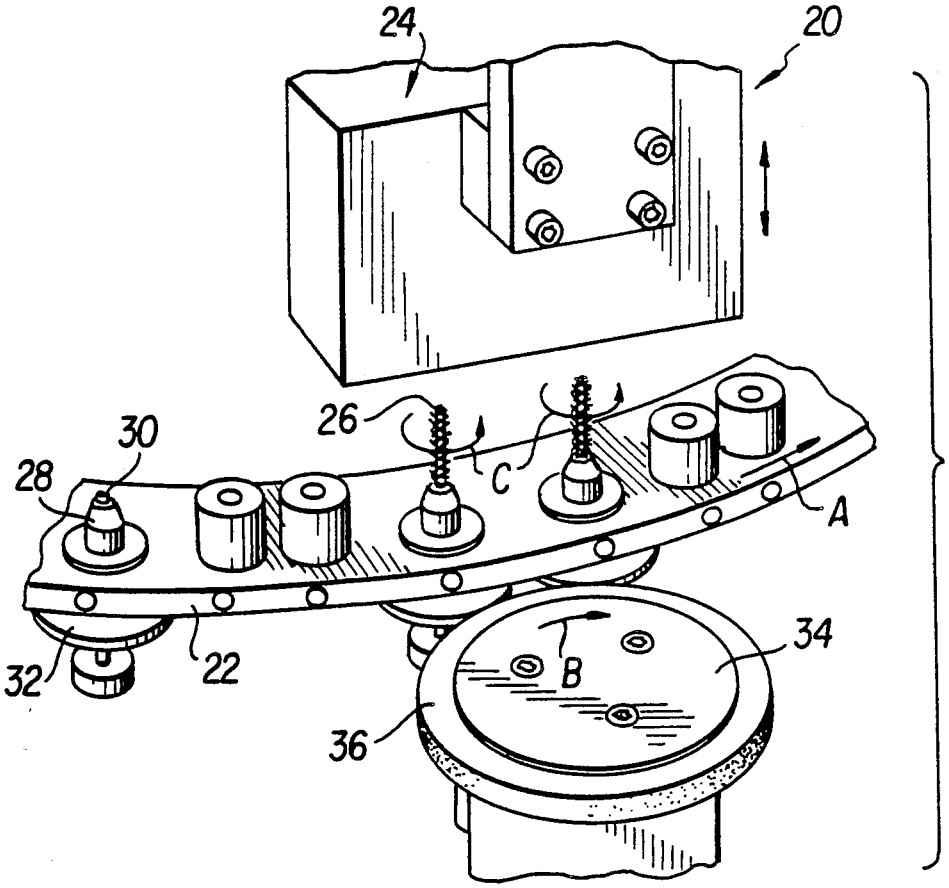
FIG. 1 is a perspective view of the apparatus for transporting, rotating and heating the bristle tips in accordance with the improved methodology.

FIG. 1 illustrates the apparatus 20 for rounding the tips of synthetic bristle held by a pair of twisted wires. An indexable carrier wheel 22 is used to transport the brushes to be acted upon by a heating chamber 24. Each of the twisted wire brushes 26 is held in a vertical position by a rotatable spindle assembly 28 which includes a chuck 30 for grasping the twisted wire portion of a brush 26. Each spindle assembly 28 is journaled for rotation in the carrier wheel 22 Extending from the underside of the carrier wheel 22 and coupled for rotation with each spindle assembly 28 is an idler wheel 32, which when rotated, rotates spindle 28.

In operation, the carrier wheel 22 is rotated in direction A and halted (i.e., indexed) so that brushes 26 are positioned beneath the heating chamber 24. At this point, the idler wheels 32 will be engaged by a drive wheel 34 which rotates in direction B. The drive wheel 34 has a rubber rim 36 which contacts the idler wheels 32 of two spindle assemblies 28 to rotate them in direction C. At this point, the heating chamber 24 is displaced vertically down upon the two rotating brushes 26.

Figure 2:
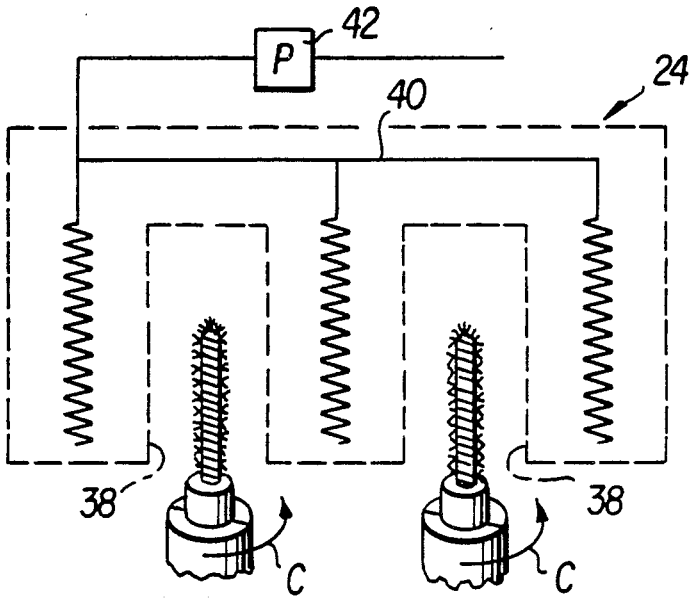
FIG. 2 is a cross-sectional view of a first configuration of a heating chamber acting upon the individual twisted wire brushes.

A cross-sectional diagram of a first heating chamber 24 is shown in FIG. 2. The heating chamber 24 contains multiple hollow cavities 38 having continuous (preferably cylindrical) inner walls which, when heating chamber 24 is lowered, will surround the twisted wire brushes 26. Contained within the heating chamber 24 are a series of electrical heating elements 40 which are connected to a power supply 42 for causing heat to radiate into the hollow cylindrical cavities 38 towards the rotating twisted wire brushes 26. The heating element 40 can be any suitable heating element such as electrical resistance wire. Since the heating chamber 24 and the walls of the cavities 38 are constructed from metal such as steel, the heat is evenly disposed about the chamber and this, in conjunction with the rotation of the brushes 26, ensures that the melting of the bristle tips is uniform and controllable. Furthermore, the uniform heating prevents the melted tips of the bristles from sticking to one another.

After waiting a predetermined period of time as the brush tips melt, which is determined empirically from the size, shape, type and material of the bristles, the heating chamber 24 is displaced upwardly away from the brushes 26. Thereafter, the carrier wheel 22 is again indexed in the direction A, which moves the completed brushes away from the heating chamber 24, and the next pair of brushes is positioned for the heating process to be repeated. After processing, the brushes may be removed from the spindle assemblies 28 by any suitable means, either automatically or manually. After processing, the individual bristles have a spherical ball at each end. The balls have a diameter greater than the shaft of the bristle which greatly lessens the chance of injury and aids in the retention of the fluid, such as mascara, which is applied by the brush. The size of the ball can be controlled by the heating time.

Figure 3:
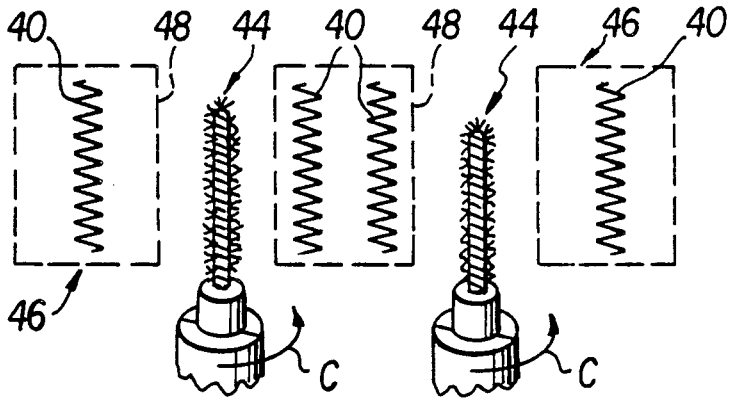
FIG. 3 is a cross-sectional view of a second configuration of a heating chamber.

For certain applications, it is desirable that all of the bristle tips not be rounded. For example, it is desirable with respect to brushes that have a tapered profile, that only the longer bristles near the handle end be rounded, with the shorter brushes remaining unprocessed. A second embodiment of a heating chamber shown in FIG. 3 provides such a result. In FIG. 3, brushes 44 having a tapered profile are processed in a heating chamber 46 which has cavities 48 which are open at the top and extend only over a portion of the length of the brushes 44. The upper the brushes 44 extend out of the cavities 48, and the bristles on the upper portions thus remain unheated and unrounded. The cavities 48 are heated and the brushes rotated in a similar manner to that of the chamber 24 of FIG. 2.

It is to be noted, that many modifications may be made to the above described system. For example, the carrier wheel 22 could be replaced by a linear conveyor. Furthermore, the heating chambers could have anywhere from one to a large number of cavities for processing brushes, dependent upon the volume required. Also, the idler wheel system could be replaced by any other suitable means for rotating the brush-holding spindles. Such modifications and variations are considered to be within the purview and scope of the invention and the appended claims.

What is claimed is:

1. Apparatus for producing rounded tips on heat meltable bristles of brushes having longitudinal axes, said apparatus comprising:

(a) a heating chamber having at least one hollow cavity having at least one opening and a continuous inner wall surrounding said at least one opening;

(b) first means for mounting a plurality of brushes;

(c) second means for rotating each brush about its longitudinal axis;

(d) third means for intermittently translating said plurality of brushes; and (e) fourth means for moving said heating chamber back and forth between a first position in which said at least one hollow cavity receives a corresponding one of said plurality of brushes while it is stopped with said continuous inner wall of said at least one hollow cavity being at least generally parallel to the longitudinal axis of the brush and a second position in which said at least one hollow cavity is spaced from said plurality of brushes.

2. Apparatus as recited in claim 1 wherein said heating chamber has plurality of hollow cavities.

3. Apparatus as recited in claim 1 wherein said at least one hollow cavity is cylindrical.

4. Apparatus as recited in claim 1 wherein said second means comprises:

(a) a plurality of idler wheels, each one of said plurality of idler wheels being operatively connected to a corresponding one of said first means, and (b) a drive wheel that is selectively engageable with each of said plurality of idler wheels.

5. Apparatus as recited in claim 4 wherein said drive wheel is simultaneously engageable with a plurality of said idler wheels.

6. Apparatus as recited in claim 1 wherein said third means comprises an indexable carrier wheel.

7. Apparatus as recited in claim 6 wherein said second means comprises a plurality of rotatable spindle assemblies mounted on said indexable carrier wheel.

8. Apparatus as recited in claim 1 wherein said at least one hollow cavity has a single opening into which the brushes extend.

9. Apparatus as recited in claim 1 wherein said at least one hollow cavity has an opening at each end of said continuous inner wall.

10. A method for producing rounded tips on heat meltable bristles of brushes having longitudinal axes, said method comprising the steps of:

(a) providing a hollow cylinder, said hollow cylinder having walls which are heated to a temperature sufficient to melt the material of the brush bristles;

(b) inserting a brush into said hollow cylinder;

(c) rotating said brush within said hollow cylinder until the tips of said brush bristles are melted; and (d) removing said brush from within said hollow cylinder.

11. The method as claimed in claim 1 and further including the step of translating said brushes laterally with respect to said hollow cylinder before and after step b.

12. The method as claimed in claim 10 and further including the step of mounting said bushes on an indexable wheel in a rotatable manner.

13. The method as claimed in claim 10 and further including the step of displacing said hollow cylinder along the longitudinal axis of said brush in order to insert and remove said brush from said hollow cylinder.

14. The method as claimed in claim 10 and further including the step of providing multiple hollow cylinders for receiving multiple brushes.

* * * * *